US011939970B2

(12) United States Patent
Okaguchi

(10) Patent No.: US 11,939,970 B2
(45) Date of Patent: Mar. 26, 2024

(54) CONTROL ARRANGEMENT FOR FIRST AND SECOND PIEZOELECTRIC PUMPS POSITIONED IN SERIES

(71) Applicant: Murata Manufacturing Co., Ltd., Kyoto (JP)

(72) Inventor: Kenjiro Okaguchi, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 182 days.

(21) Appl. No.: 17/469,395

(22) Filed: Sep. 8, 2021

(65) Prior Publication Data

US 2021/0404461 A1 Dec. 30, 2021

Related U.S. Application Data

(63) Continuation of application No. PCT/JP2020/015392, filed on Apr. 3, 2020.

(30) Foreign Application Priority Data

Apr. 25, 2019 (JP) ..... 2019-084139

(51) Int. Cl.
*F04B 43/04* (2006.01)
*F04B 23/02* (2006.01)
(Continued)

(52) U.S. Cl.
CPC ..... *F04B 43/046* (2013.01); *F04B 41/06* (2013.01); *F04B 49/06* (2013.01); *F04B 23/02* (2013.01)

(58) Field of Classification Search
CPC ... F04B 2203/0401; F04B 49/06; F04B 23/02
See application file for complete search history.

(56) References Cited

U.S. PATENT DOCUMENTS 4,822,250 A 4/1989 Tsubouchi et al.
5,910,698 A 6/1999 Yagi
(Continued)

FOREIGN PATENT DOCUMENTS

DE 19653636 A1 6/1998
DE 10045118 A1 3/2002
(Continued)

OTHER PUBLICATIONS

International Search Report for International Application No. PCT/JP2020/015392 dated Jun. 9, 2020.
(Continued)

*Primary Examiner* — Nathan C Zollinger
(74) *Attorney, Agent, or Firm* — Pearne & Gordon LLP

(57) ABSTRACT

A pump device including a first piezoelectric pump, a second piezoelectric pump connected in series with the first piezoelectric pump on a downstream side of the first piezoelectric pump, a drive unit configured to supply AC power as input power to each of the first piezoelectric pump and the second piezoelectric pump, a control unit configured to control input power to the first piezoelectric pump and the second piezoelectric pump, and a power supply unit configured to supply power to the drive unit, in which the control unit sets input power of the second piezoelectric pump to be larger than input power of the first piezoelectric pump.

14 Claims, 11 Drawing Sheets

(51) Int. Cl.
*F04B 41/06* (2006.01)
*F04B 49/06* (2006.01)

(56) References Cited

U.S. PATENT DOCUMENTS

| | | | | |
|---|---|---|---|---|
| 11,391,278 | B2 * | 7/2022 | Okaguchi | F04B 43/0045 |
| 11,639,714 | B2 * | 5/2023 | Tanaka | F04B 17/003 417/410.1 |
| 2003/0185687 | A1 | 10/2003 | Lemmen | |
| 2003/0215342 | A1 * | 11/2003 | Higashino | F16K 99/0001 417/322 |
| 2005/0180855 | A1 | 8/2005 | Horiuchi et al. | |
| 2005/0219302 | A1 * | 10/2005 | Vogeley | F04B 43/046 347/19 |
| 2012/0051946 | A1 | 3/2012 | Lee et al. | |
| 2012/0265125 | A1 * | 10/2012 | Kawamura | A61M 5/145 604/67 |
| 2013/0200751 | A1 | 8/2013 | Schroeder | |
| 2013/0223979 | A1 * | 8/2013 | Locke | G01F 1/383 415/118 |
| 2015/0337828 | A1 * | 11/2015 | Refai-Ahmed | H01L 23/467 417/45 |
| 2018/0335029 | A1 | 11/2018 | Fujisaki | |
| 2020/0378373 | A1 | 12/2020 | Tanaka | |

FOREIGN PATENT DOCUMENTS

| | | | |
|---|---|---|---|
| DE | 69713459 | T2 | 1/2003 |
| DE | 60315307 | T2 | 12/2007 |
| DE | 102013200353 | A1 | 9/2013 |
| JP | S63-297779 | A | 12/1988 |
| JP | H07-301182 | A | 11/1995 |
| JP | 2004-169706 | A | 6/2004 |
| JP | 2012-047172 | A | 3/2012 |
| WO | 2017/135206 | A1 | 8/2017 |
| WO | 2019/202831 | A1 | 10/2019 |
| WO | 2022/209481 | A1 | 10/2022 |

OTHER PUBLICATIONS

Written Opinion for International Application No. PCT/JP2020/015392 dated Jun. 9, 2020.

* cited by examiner

CONTROL ARRANGEMENT FOR FIRST AND SECOND PIEZOELECTRIC PUMPS POSITIONED IN SERIES

CROSS REFERENCE TO RELATED APPLICATIONS

This is a continuation of International Application No. PCT/JP2020/015392 filed on Apr. 3, 2020 which claims priority from Japanese Patent Application No. 2019-084139 filed on Apr. 25, 2019. The contents of these applications are incorporated herein by reference in their entireties.

BACKGROUND

Technical Field

The present disclosure relates to a pump device, and more particularly to a pump device including a piezoelectric pump.

An existing pump device including a piezoelectric pump is used as a suction device or a pressurizing device for a fluid. The piezoelectric pump is driven by vibration of a piezoelectric element.

For example, a pump device described in Patent Document 1 is a pump device in which a plurality of piezoelectric pumps is connected in series. The pump device drives each piezoelectric pump by applying a phase difference to input power of adjacent piezoelectric pumps among the plurality of piezoelectric pumps. Thus, the pulsation of pressure in the case of connecting a plurality of piezoelectric pumps in series is relaxed.

The piezoelectric pump used in the pump device of Patent Document 1 has a structure in which a piezoelectric element is bonded to a metal plate, and supplies AC power to the piezoelectric element and the metal plate to cause bending deformation in a unimorph mode, thereby transporting air.

Patent Document 1: Japanese Unexamined Patent Application Publication No. 2004-169706

BRIEF SUMMARY

When using the piezoelectric pumps that are connected in series, a pressure difference between a suction port and a discharge port of each piezoelectric pump differs between the piezoelectric pumps. As a result, a difference in amplitude occurs between the piezoelectric elements of the respective piezoelectric pumps, and power efficiency of the entire pump device decreases.

The present disclosure provides a pump device in which power efficiency of piezoelectric pumps connected in series is improved.

A pump device according to the present disclosure includes:

- a first piezoelectric pump;
- a second piezoelectric pump connected in series with the first piezoelectric pump on a downstream side of the first piezoelectric pump;
- a drive unit configured to supply AC input power to each of the first piezoelectric pump and the second piezoelectric pump; and
- a control unit configured to control the input power of each of the first piezoelectric pump and the second piezoelectric pump; and
- a power supply unit configured to supply power to the drive unit, in which the control unit sets input power of the second piezoelectric pump to be larger than input power of the first piezoelectric pump.

According to a pump device of the present disclosure, power efficiency of piezoelectric pumps connected in series can be improved.

DETAILED DESCRIPTION

Figure 1:
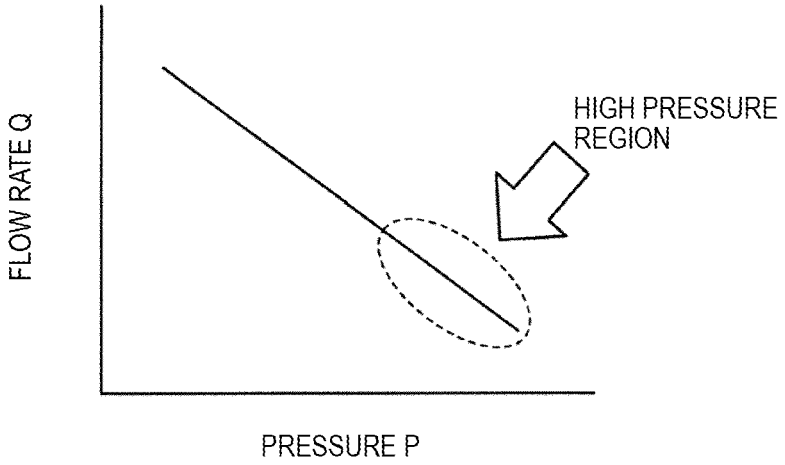
FIG. 1 is a graph showing pressure-flow rate characteristics of a piezoelectric pump.

A pump device according to an aspect of the present disclosure includes a first piezoelectric pump, a second piezoelectric pump connected in series with the first piezoelectric pump on a downstream side of the first piezoelectric pump, a drive unit configured to supply AC input power to each of the first piezoelectric pump and the second piezoelectric pump, a control unit configured to control the input power of each of the first piezoelectric pump and the second piezoelectric pump, and a power supply unit configured to supply power to the drive unit, in which the control unit sets input power of the second piezoelectric pump to be larger than input power of the first piezoelectric pump.

According to this configuration, even when a pump pressure of the second piezoelectric pump on a downstream side becomes higher than a pump pressure of the first piezoelectric pump on an upstream side, since the input power of the second piezoelectric pump is larger than the input power of the first piezoelectric pump, it is possible to prevent an amplitude of a piezoelectric element of the second piezoelectric pump from decreasing. As a result, since the amplitudes of the piezoelectric elements of the first piezoelectric pump and the second piezoelectric pump are close to each other, it is possible to improve the overall power efficiency of the piezoelectric pumps connected in series.

In addition, the drive unit may include a first drive unit that supplies AC input power to the first piezoelectric pump and a second drive unit that supplies AC input power to the second piezoelectric pump, and the control unit may set power supplied from the power supply unit to the second drive unit to be larger than power supplied from the power supply unit to the first drive unit. With this configuration, since the drive unit is provided separately for the piezoelectric pump, the piezoelectric pump can be driven with high accuracy. Further, by making the power supplied to the second drive unit larger than the power supplied to the first drive unit, it becomes easy to make the input power of the second piezoelectric pump larger.

In addition, a first current detection unit that detects a current flowing through the first drive unit and a second current detection unit that detects a current flowing through the second drive unit may be included, and the control unit may control input power supplied to the second piezoelectric pump by the second drive unit such that a current value detected by the second current detection unit is brought close to a current value detected by the first current detection unit. By bringing the value of the current flowing through the second drive unit close to the value of the current flowing through the first drive unit, the amplitude of the second piezoelectric pump can be brought close to the amplitude of the first piezoelectric pump even in a high pressure region, and thus it is possible to further improve the power efficiency.

In addition, the control unit may control a duty ratio of a drive voltage of the second piezoelectric pump. Thus, a drive current of the second piezoelectric pump can be easily controlled.

In addition, the control unit may control drive frequencies of the first piezoelectric pump and the second piezoelectric pump. Thus, the power efficiency can be further improved.

In addition, a current ratio between a current flowing through the first piezoelectric pump and a current flowing through the second piezoelectric pump may be in a range of equal to or more than 0.8 and equal to or less than 1.2. Since the current flowing through the first piezoelectric pump and the current flowing through the second piezoelectric pump are within a range of values close to each other, the amplitudes of the first piezoelectric pump and the second piezoelectric pump can be brought close to each other, and the power efficiency can be increased.

In addition, a current ratio between a current flowing through the first drive unit and a current flowing through the second drive unit may be in a range of equal to or more than 0.8 and equal to or less than 1.2. Since the current flowing through the first drive unit and the current flowing through the second drive unit are within a range of values close to each other, the amplitudes of the first piezoelectric pump and the second piezoelectric pump can be brought close to each other, and the power efficiency can be increased.

In addition, a container connected to a suction port of the first piezoelectric pump or a discharge port of the second piezoelectric pump may be included.

It should be noted that each of the embodiments described below shows a specific example of the present disclosure, and the present disclosure is not limited to this configuration. In addition, numerical values, shapes, configurations, steps, orders of steps, and the like specifically shown in the following embodiments are merely examples, and do not limit the present disclosure. Among the constituent elements in the following embodiments, constituent elements that are not described in an independent claim indicating the highest order concept are described as arbitrary constituent elements. In addition, in all the embodiments, the configurations in the respective modified examples are the same, and the configurations described in the respective modified examples may be combined with each other.

First, the problem of the present disclosure will be described in more detail. As shown in FIG. 1, the piezoelectric pump used in the pump device has a characteristic that a flow rate Q decreases as a back pressure P increases. This is because the higher the pressure, the smaller the amplitude of the piezoelectric element of the piezoelectric pump. Therefore, in order to increase the flow rate Q in the high pressure region, it is conceivable to increase the current flowing through the piezoelectric element of the piezoelectric pump.

Figure 2:
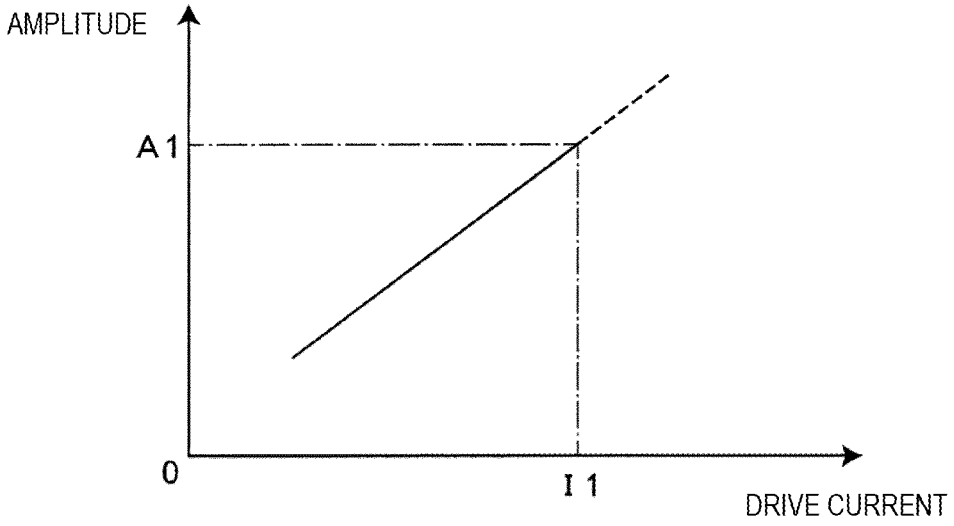
FIG. 2 is a graph showing a relationship between a drive current of the piezoelectric pump and an amplitude of a piezoelectric element.

As shown in FIG. 2, there is a high correlation between the drive current of the piezoelectric pump and the amplitude of the vibration of the piezoelectric element. As the drive current increases, the amplitude of the piezoelectric element also increases. However, when a drive current value I1 flows through the piezoelectric element, there is an upper limit value A1 of the amplitude at which the piezoelectric element is broken, for example, cracks occur in the piezoelectric element. Therefore, it is suitable to use the piezoelectric pump in a state in which the amplitude of the piezoelectric element is equal to or less than the upper limit value A1.

Figure 3:
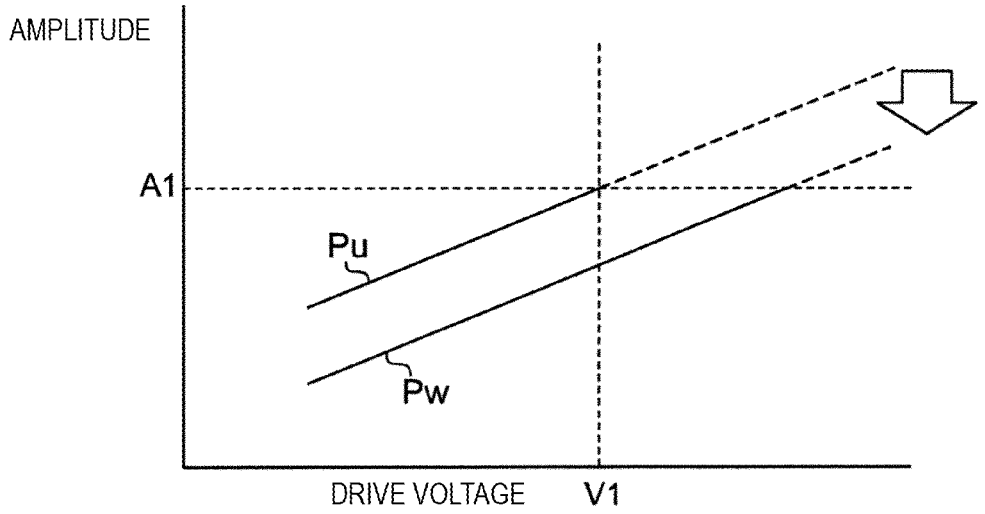
FIG. 3 is a graph showing a relationship between a drive voltage of the piezoelectric pump and the amplitude of the piezoelectric element.

In the case where two piezoelectric pumps Pu and Pw having the same pump capacity are connected in series, when each of the pumps is driven and the pressure increases, as shown in FIG. 3, the amplitude of the piezoelectric element of the piezoelectric pump Pw arranged on the downstream side is small as compared with the piezoelectric pump Pu arranged on the upstream side. When the upper limit value is determined by the drive voltage of the piezoelectric pump, the amplitude of the piezoelectric element of the piezoelectric pump Pw on the downstream side is small, and it takes a long time until the target pressure is reached. Therefore, embodiments of the disclosure of the present application for solving such problems will be described in order.

Embodiment 1

Figure 4:
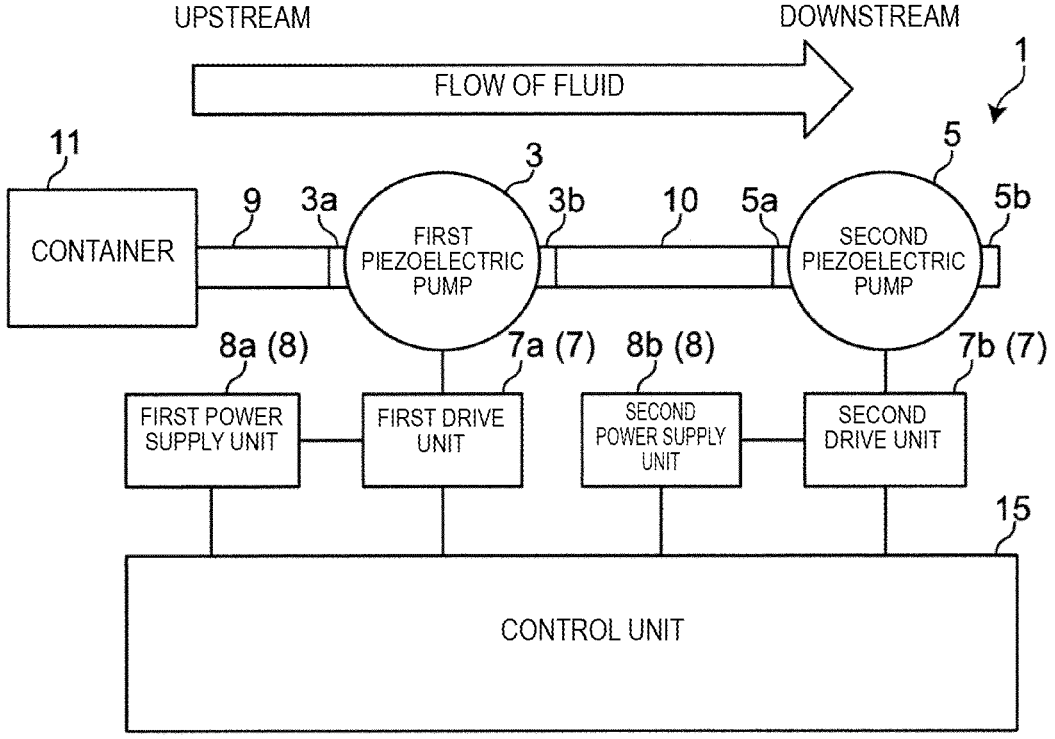
FIG. 4 is a diagram illustrating a schematic configuration of a pump device according to Embodiment 1.

Hereinafter, a pump device according to Embodiment 1 of the present disclosure will be described. FIG. 4 is a schematic configuration of the pump device 1 according to Embodiment 1.

The pump device 1 illustrated in FIG. 4 includes a first piezoelectric pump 3, a second piezoelectric pump 5, a drive unit 7, a power supply unit 8, and a control unit 15. The pump device 1 of Embodiment 1 is exemplified as an exhaust pump device, for example.

The first piezoelectric pump 3 and the second piezoelectric pump 5 are pumps connected in series with each other. The first piezoelectric pump 3 is arranged on an upstream side, and the second piezoelectric pump 5 is arranged on a downstream side.

Each of the first piezoelectric pump 3 and the second piezoelectric pump 5 in Embodiment 1 is a piezoelectric pump using a piezoelectric element (may be referred to as a "microblower", a "micropump", or the like). Specifically, a structure in which a piezoelectric element (not illustrated) is bonded to a metal plate (not illustrated) is provided, and AC power is supplied to the piezoelectric element and the metal plate to thereby cause bending deformation in a unimorph mode to transport a fluid. The fluid includes a gas and a liquid.

In Embodiment 1, piezoelectric pumps having the same specification may be used as the first piezoelectric pump 3 and the second piezoelectric pump 5. The first piezoelectric pump 3 and the second piezoelectric pump 5 having the same specification have the same parameters, such as a rated output (that is, a flow rate per unit time) and a size.

The drive unit 7 is, for example, a drive circuit that drives the first piezoelectric pump 3 and the second piezoelectric pump 5 with AC power. The drive unit 7 supplies AC power to the first piezoelectric pump 3 and the second piezoelectric pump 5. In Embodiment 1, the drive unit 7 includes a first drive unit 7*a* that supplies AC power to the first piezoelectric pump 3 and a second drive unit 7*b* that supplies AC power to the second piezoelectric pump 5. Which are simply referred to as the drive unit 7 in the following description, when meaning both the first drive unit 7*a* and the second drive unit 7*b*.

The power supply unit 8 is, for example, a power supply circuit that supplies power to the drive unit 7. The power supply unit 8 includes a first power supply unit 8*a* that supplies DC power to the first drive unit 7*a* and a second power supply unit 8*b* that supplies DC power to the second drive unit 7*b*.

A control unit 15 is connected to the drive unit 7. The control unit 15 controls power, voltage, current, drive frequencies, and the like output from each of the first drive unit 7*a* and the second drive unit 7*b* to each of the first piezoelectric pump 3 and the second piezoelectric pump 5. Therefore, an input current of each of the first piezoelectric pump 3 and the second piezoelectric pump 5 is controlled by the control unit 15. In addition, the control unit 15 controls an output voltage from the power supply unit 8 to the drive unit 7. The control unit 15 is configured by, for example, an arithmetic device, such as a micro controller unit (MCU) and a processor. Note that, the control unit may also include a storage device, such as a memory and an SDD.

A container 11 is a target object to which a fluid is sucked by the first piezoelectric pump 3 and the second piezoelectric pump 5 of the pump device 1. Examples of a suctioning device including the container 11 and the pump device 1 include, for example, a breast pump, a nasal aspirator, an oral care device, a drainage device, and the like, but any other suctioning device may be used. The container 11 and the first piezoelectric pump 3 are connected with a pipe 9 interposed therebetween, and the first piezoelectric pump 3 and the second piezoelectric pump 5 are connected with a pipe 10 interposed therebetween.

The first piezoelectric pump 3 has a suction port 3*a* for sucking a fluid and a discharge port 3*b* for discharging a fluid. The suction port 3*a* is connected to the pipe 9, and the discharge port 3*b* is connected to the pipe 10. In addition, the second piezoelectric pump 5 has a suction port 5*a* for sucking a fluid and a discharge port 5*b* for discharging a fluid. The suction port 5*a* is connected to the pipe 10, and the discharge port 5*b* is opened to the atmosphere.

The pump device 1 sucks, for example, air from the container 11, whereby a negative pressure is generated inside the container 11. The pump device 1 having such a configuration functions as a so-called "negative pressure pump".

According to the configuration of the pump device 1 described above, AC power is supplied to the first piezoelectric pump 3 and the second piezoelectric pump 5 from the first drive unit 7*a* and the second drive unit 7*b*, respectively. The first piezoelectric pump 3 and the second piezoelectric pump 5 each are driven by the supply of the AC power, and the piezoelectric element is bent and deformed at a high speed, thereby transporting air.

The first piezoelectric pump 3 sucks air from the container 11. The first piezoelectric pump 3 exhausts the sucked air to the second piezoelectric pump 5, as well as further reducing the pressure inside the first piezoelectric pump 3 to transport the air to the second piezoelectric pump 5. The second piezoelectric pump 5 exhausts the sucked air from the discharge port 5*b* to the atmosphere, as well as further reducing the pressure inside the second piezoelectric pump 5 to exhaust the air from the discharge port 5*b* to the atmosphere.

Figure 5:
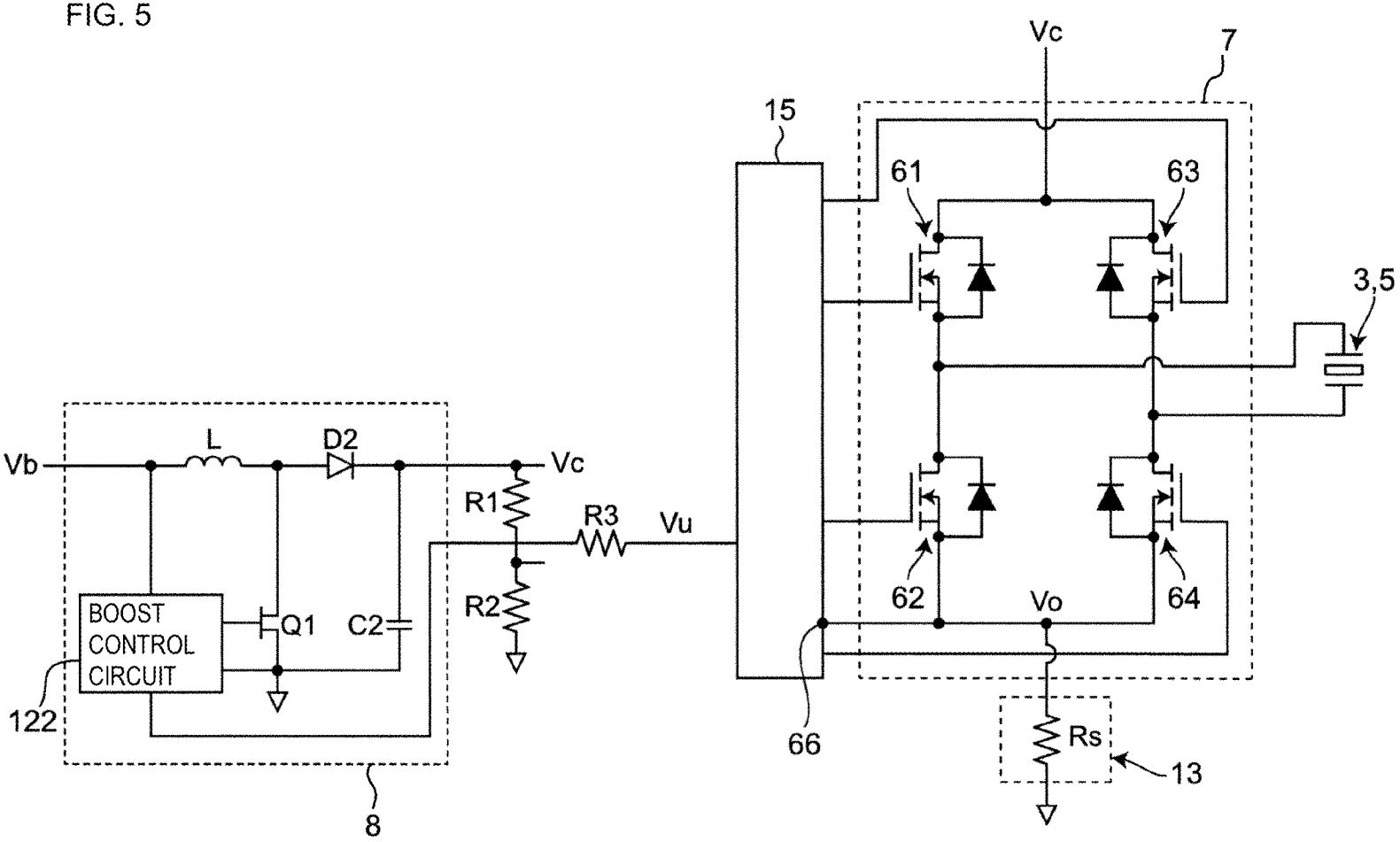
FIG. 5 is a circuit diagram of a drive unit, a voltage detection unit, and a power supply unit according to Embodiment 1.

Next, an example of a circuit of the drive unit 7 and the power supply unit 8 will be described with reference to FIG. 5. The drive unit 7 is, for example, an H-bridge circuit. The drive unit 7 includes four FETs of a first FET 61, a second FET 62, a third FET 63, and a fourth FET 64. Each of the FETs is switching-driven by a drive signal from the control unit 15 to the first FET 61 to the fourth FET 64, and an AC voltage with a predetermined frequency is applied to the first and second piezoelectric pumps 3 and 5.

An input voltage Vc is applied from the power supply unit 8 to drains of the first FET 61 and the third FET 63. A source of the first FET 61 is connected to a drain of the second FET 62 and an external connection terminal of the piezoelectric pump. A source of the third FET 63 is connected to a drain of the fourth FET 64 and an external connection terminal of the piezoelectric pump. A source of the second FET 62 and a source of the fourth FET 64 are connected to a voltage detection circuit 13. The voltage detection circuit 13 includes an impedance element electrically connected to the piezoelectric pump. As the impedance element, for example, a resistor Rs is used.

The DC input voltage Vc supplied from the power supply unit 8 is divided by the first FET 61, the piezoelectric pump, the fourth FET 64, and the resistor Rs or divided by the third FET 63, the piezoelectric pump, and the second FET 62. Here, voltage drop in the first FET 61 to the fourth FET 64 is negligibly small. Therefore, an output voltage Vo is determined by voltage division between the first and second piezoelectric pumps 3 and 5 and the resistor Rs.

The voltage detection circuit 13 is, for example, the resistor Rs. By detecting a voltage across the resistor Rs, the output voltage Vo of a drive circuit 12 can be detected. In addition, the control unit 15 can calculate a value of a current flowing through the drive circuit based on a voltage value detected by the voltage detection circuit 13. When a drive current Ic flowing through the resistor Rs is Io, the power efficiency of the first and second piezoelectric pumps 3 and 5 is maximized. The current Io is obtained by Io=Vo/Rs. Since the resistor Rs causes a circuit loss, a low resistance having a small value such as 1Ω is desirable. The difference between the input voltage Vc and the output voltage Vo is an applied voltage (drive voltage) to the piezoelectric pumps 3 and 5. Since one end side of the resistor Rs is connected to an I/O port 66 of the control unit 15, the output voltage Vo is read by the control unit 15. A current detection unit of the disclosure of the present application includes the voltage detection circuit 13 and the control unit 15. In addition, the control unit 15 also corresponds to the control unit of the disclosure of the present application.

The control unit 15 controls the voltage Vc supplied by sending a feedback signal to the power supply unit 8 according to the output voltage Vo. In a case where the pump device 1 is a suction device, the control unit 15 relatively lowers the voltage Vc supplied to the first drive unit 7*a* that drives the first piezoelectric pump 3 on the upstream side, compared to the voltage Vc supplied to the second drive unit 7*b* that drives the second piezoelectric pump 5 on the downstream side.

The power supply unit 8 includes a boost control circuit 122, a switch element Q1, an inductor L, a diode D2, and a capacitor C2. As illustrated in FIG. 5, the boost control circuit 122 boosts, for example, an input power supply voltage Vb (for example, DC 1.5 V) input from a cell by switching control on the switch element Q1, based on a voltage Vu which is a control signal. The power supply unit 8 outputs the boosted DC power supply voltage Vc (for example, DC 30 V). The DC power supply voltage Vc output from the power supply unit 8 is supplied to the drive unit 7.

The output voltage Vo may be a constant value, or may be a variable value that varies below a predetermined upper limit value. In addition, the output voltage Vo may be rewritten during the operation of the piezoelectric pumps 3 and 5.

Figure 6:
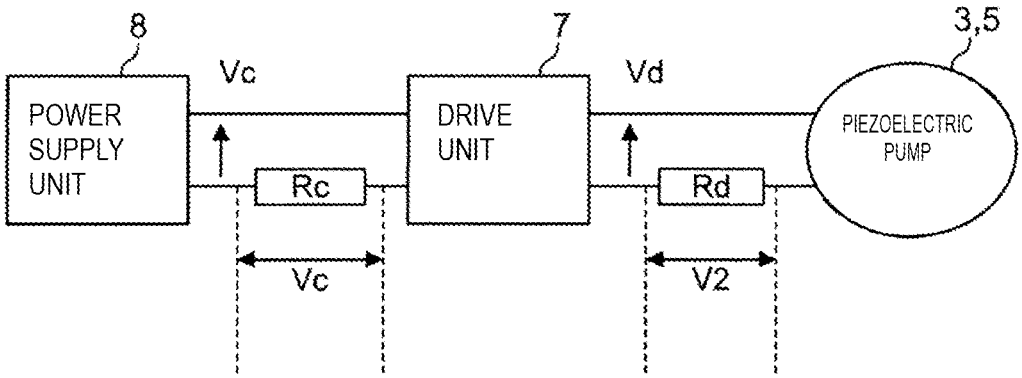
FIG. 6 is a diagram illustrating an example of current value measurement.

Next, with reference to FIG. 6, a method of obtaining current and power of the piezoelectric pumps 3 and 5 and the drive unit 7 will be described. The DC current Ic flowed into the drive circuit of the drive unit 7 and a DC power Pc applied to the drive circuit of the drive unit 7 are obtained by the following expressions.

$$Ic=Vc/Rc \quad \text{Expression (1)}$$

$$Pc=Vc\times Ic \quad \text{Expression (2)}$$

In addition, a current Id flowing into the piezoelectric pumps 3 and 5 and a power Pd flowing into the piezoelectric pumps 3 and 5 are obtained by the following expressions.

$$Id=Vd/Rd \quad \text{Expression (3)}$$

$$Pd=Vd\times Id\times\cos\theta \quad \text{Expression (4)}$$

In the Expression (4), θ is a phase difference between an input voltage Vd and the input current Id of the piezoelectric pumps 3 and 5.

The current to the drive circuit to be obtained is an instantaneous value or an average value. In addition, the power of the drive circuit to be obtained is also an instantaneous value or an average value. The power of the piezoelectric pumps 3 and 5 may be an integral value of one-cycle of vibration of the piezoelectric element.

Figure 7:
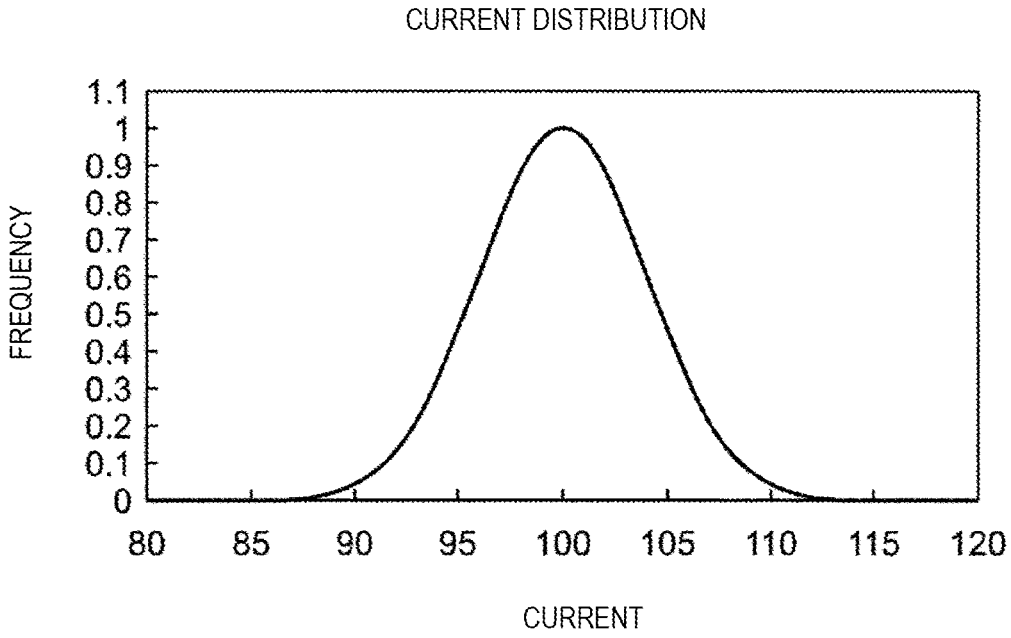
FIG. 7 is a graph showing current distribution.

Next, the range of the current value to be obtained will be described with reference to FIG. 7. Even using the piezoelectric pumps 3 and 5 that are the same product, since there is individual difference, variation occurs in the current value when the piezoelectric elements have the same amplitude. For example, when an ideal current value is 100, current values having values of ±20% are treated as the same current value. That is, the current values in the range from 80 to 120 are treated as the same current value. That is, a current ratio between a current flowing through the first piezoelectric pump 3 and a current flowing through the second piezoelectric pump 5 is in the range of equal to or more than 0.8 and equal to or less than 1.2. In addition, a current ratio between a current flowing through the first drive unit 7*a* and a current flowing through the second drive unit 7*b* is in the range of equal to or more than 0.8 and equal to or less than 1.2.

Figure 8:
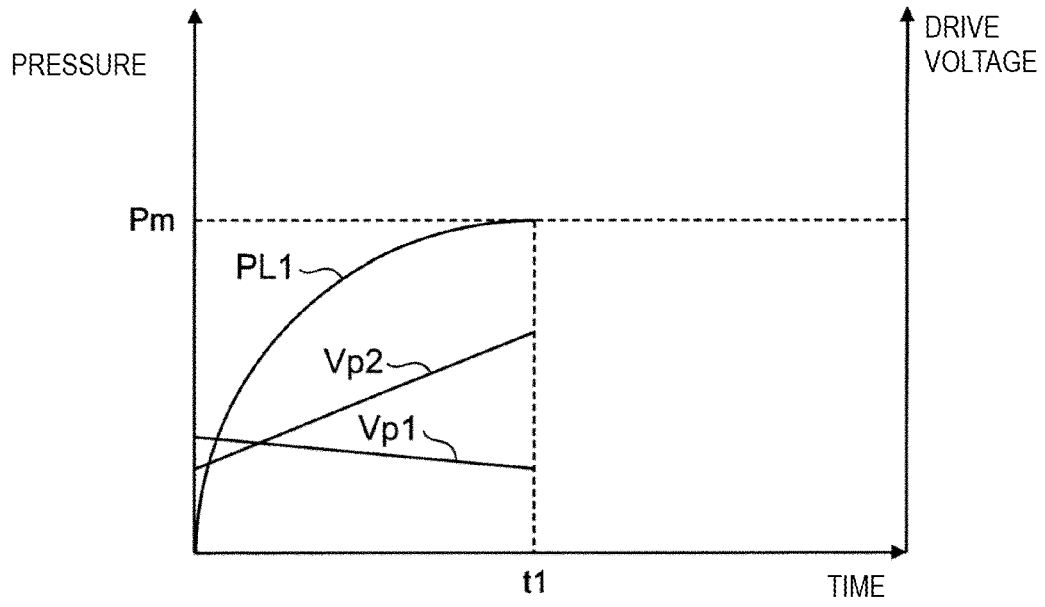
FIG. 8 is a graph showing a relationship between an ultimate pressure and time in Embodiment 1.
Figure 9:
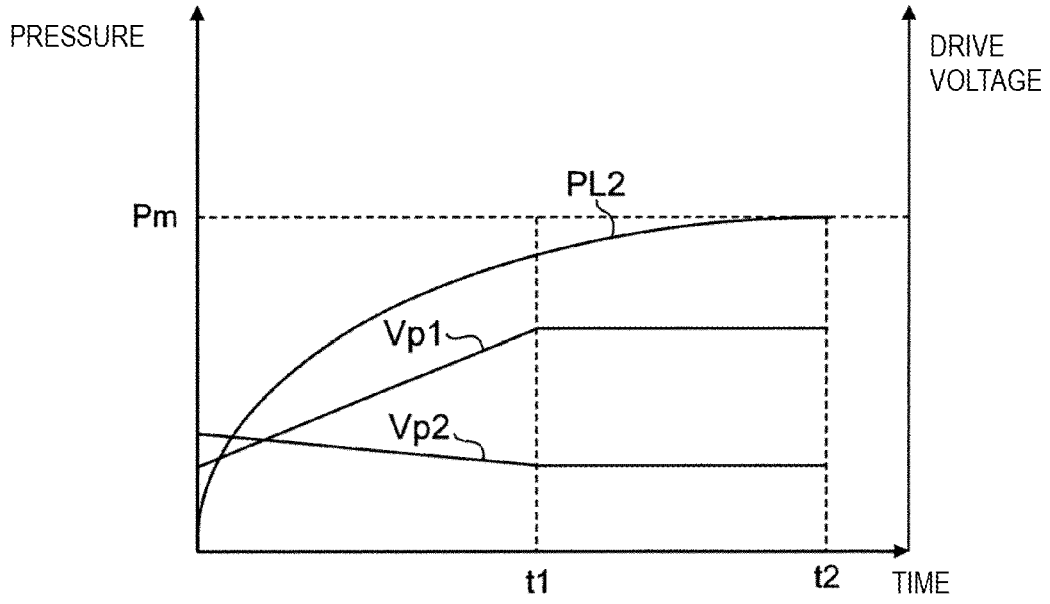
FIG. 9 is a graph showing a relationship between an ultimate pressure and time in a comparative example.

The effects of the pump device 1 according to Embodiment 1 will be described with reference to FIG. 8 and FIG. 9. FIG. 8 is a graph showing a relationship between an ultimate pressure and time in Embodiment 1. FIG. 9 is a graph showing a relationship between an ultimate pressure and time in a comparative example. As shown in FIG. 8, an input power Vp2 of the second piezoelectric pump 5 is made larger than an input power Vp1 of the first piezoelectric pump 3 as a negative pressure in the container 11 increases, it is possible to reduce the reduction in the amplitude of the piezoelectric element of the second piezoelectric pump 5. Therefore, the pump capacity of the second piezoelectric pump 5 can be maintained, and for example, the pressure in the container 11 decreases by Pm at a time t1.

As shown in FIG. 9, as a comparative example, when the input power Vp1 of the first piezoelectric pump 3 is made larger than the input power Vp2 of the second piezoelectric pump 5 as the negative pressure in the container 11 increases, a target letdown pressure Pm is reached at, for example, a time t2 even in a case where the total value of the input power to the first piezoelectric pump 3 and the second piezoelectric pump 5 up to the time t1 is the same as that in FIG. 8, and more time is required to reach the target pressure. Therefore, according to Embodiment 1, the target pressure can be reached earlier.

Figure 10:
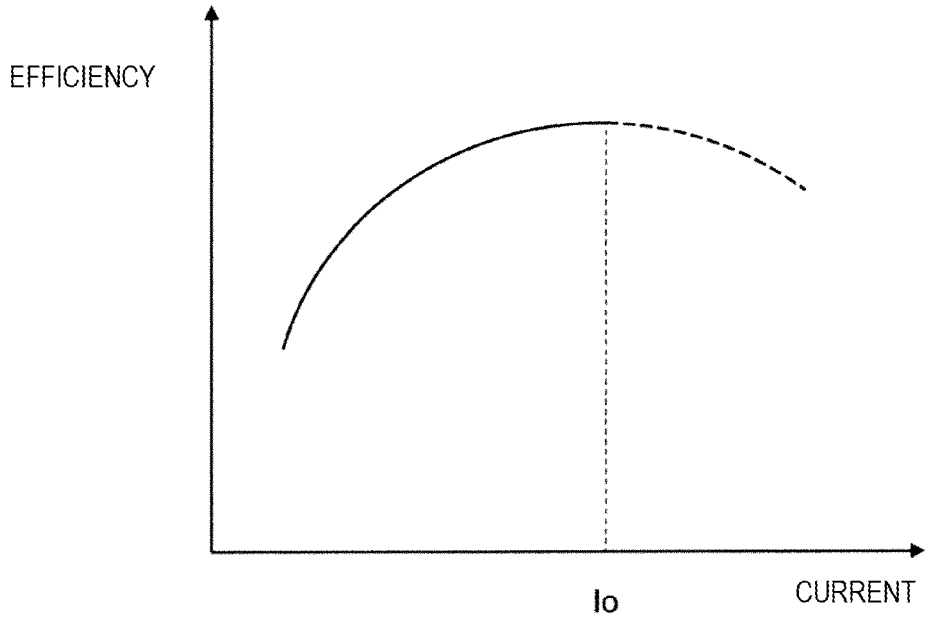
FIG. 10 is a graph showing current efficiency.

Further, as shown in FIG. 10, by driving the first piezoelectric pump 3 and the second piezoelectric pump 5 with the optimum drive current Io, it is possible to achieve the pump device 1 having high efficiency.

As described above, the pump device 1 includes the first piezoelectric pump 3, the second piezoelectric pump 5 connected in series with the first piezoelectric pump 3 on the downstream side of the first piezoelectric pump 3, the drive unit 7 that supplies AC input power to the first piezoelectric pump 3 and the second piezoelectric pump 5, the control unit 15 that controls input power to each of the first piezoelectric pump 3 and the second piezoelectric pump 5, and the power supply unit 8 that supplies power to the drive unit 7. The control unit 15 sets the input power of the second piezoelectric pump 5 larger than the input power of the first piezoelectric pump 3. With only this configuration, even when the first piezoelectric pump 3 and the second piezoelectric pump 5 are driven and a differential pressure between the suction port 5*a* and the discharge port 5*b* of the second piezoelectric pump 5 on the downstream side becomes larger than a differential pressure between the suction port 3*a* and the discharge port 3*b* of the first piezoelectric pump 3, since the input power of the second piezoelectric pump 5 is larger than the input power of the first piezoelectric pump 3, the amplitude of the piezoelectric element of the second piezoelectric pump 5 can be brought close to the amplitude of the piezoelectric element of the first piezoelectric pump 3. Therefore, the power efficiency of the piezoelectric pumps 3 and 5 connected in series can be improved.

Embodiment 2

Figure 11:
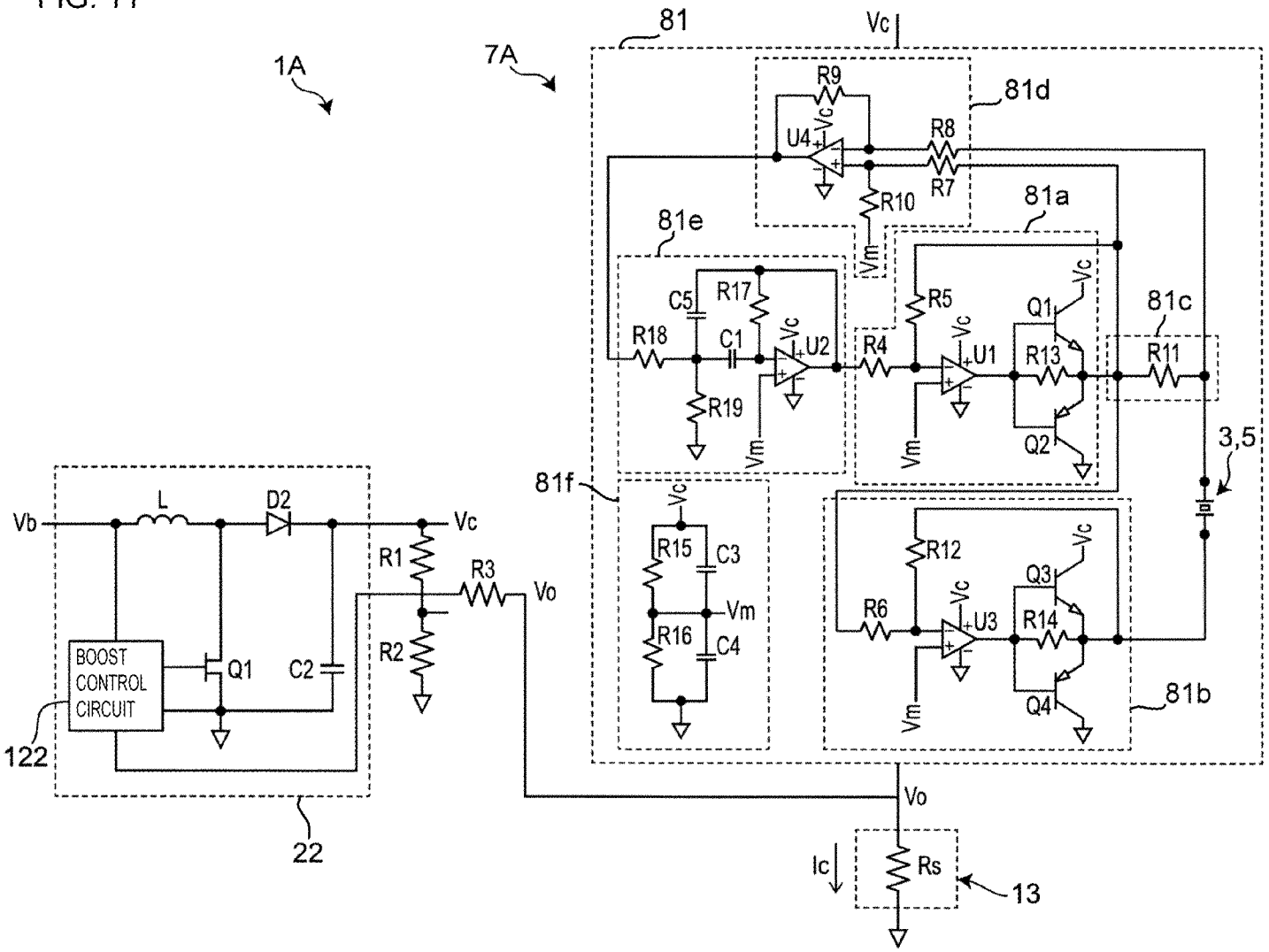
FIG. 11 is a circuit diagram of a drive unit, a voltage detection unit, and a power supply unit according to Embodiment 2.

Next, a pump device according to Embodiment 2 of the present disclosure will be described with reference to FIG. 11. FIG. 11 is a view illustrating a drive unit 7A of a pump device 1A according to Embodiment 2.

The pump device 1 according to Embodiment 1 controls the current flowing through the piezoelectric pump using the control unit 15. On the other hand, in the pump device 1A according to Embodiment 2, since a self-excitation circuit 81 is provided in the drive unit 7A, the drive unit 7A determines optimal drive frequencies of the piezoelectric pumps 3 and 5.

The pump device 1A according to Embodiment 2 includes the same components as those of the pump device 1 according to Embodiment 1. Therefore, the configuration of the pump device 1A according to Embodiment 2 is the same as that of the pump device 1 according to Embodiment 1 except for the matters described below.

The drive unit 7A includes the self-excitation circuit 81 and the voltage detection circuit 13. The self-excitation circuit 81 includes a first differential amplifier circuit 81*a*, an inverting amplifier circuit 81*b*, a current sensing portion 81*c*, a second differential amplifier circuit 81*d*, an active band filter 81*e*, and an intermediate potential generation circuit 81*f*.

A resistance R11 of the current sensing portion 81*c* is connected in series to the piezoelectric element of the piezoelectric pump. Both ends of the resistance R11 are connected to input terminals of the second differential amplifier circuit 81*d*. The second differential amplifier circuit 81*d* differentially amplifies the voltage across the resistance R11 generated by the drive current flowing through the piezoelectric element, and outputs a voltage signal.

An output terminal of the second differential amplifier circuit 81*d* is connected to an input terminal of the active band filter 81*e*. The active band filter 81*e* amplifies the input voltage signal with a predetermined gain and outputs the amplified signal. A pass band of a band pass filter in the active band filter 81*e* is set so that a resonant frequency in a predetermined vibration mode of the piezoelectric element is within the pass band.

An output terminal of the active band filter 81*e* is connected to an input terminal of the first differential amplifier circuit 81*a* and to an input terminal of the inverting amplifier circuit 81*b*. An output terminal of the first differential amplifier circuit 81*a* is connected to the resistance R11. An output terminal of the inverting amplifier circuit 81*b* is connected to the piezoelectric element.

The first differential amplifier circuit 81*a* generates a first drive signal based on the DC power supply voltage Vc output from the power supply unit 8. An output signal of the first differential amplifier circuit 81*a* is a rectangular wave having a duty ratio of 50%.

The inverting amplifier circuit 81*b* generates a second drive signal based on the DC power supply voltage Vc output from the power supply unit 8. An output signal of the inverting amplifier circuit 81*b* is a rectangular wave having a duty ratio of 50% whose phase is inverted with respect to the output signal of the first differential amplifier circuit 81*a*.

The output of the first differential amplifier circuit 81*a* is input to the upper side of the piezoelectric pumps 3 and 5, and the output of the inverting amplifier circuit 81*b* is input to the lower side of the piezoelectric pumps 3 and 5, so that currents having opposite phases flow in the upper and lower sides of the piezoelectric pumps 3 and 5.

At the start of driving of the piezoelectric pumps 3 and 5, the drive circuit voltage Vc is common between a first drive unit 7Aa on the upstream side and a second drive unit 7Ab on the downstream side. After driving, the drive circuit voltage Vc of the piezoelectric pump 5 on the downstream side is boosted until the drive current Ic flowing through the piezoelectric pump 3 on the upstream side is reached. The ratio between the power supply circuit and the drive unit 7 does not have to be 1:1. For example, an attenuator may be used.

With also the configuration of the pump device 1A according to the Embodiment 2, as in the pump device 1 according to Embodiment 1, even when the first piezoelectric pump 3 and the second piezoelectric pump 5 are driven and a pump pressure of the second piezoelectric pump 5 on the downstream side becomes larger than a pump pressure of the first piezoelectric pump 3, since the input power of the second piezoelectric pump 5 is larger than the input power of the first piezoelectric pump 3, the amplitude of the piezoelectric element of the second piezoelectric pump 5 can be brought close to the amplitude of the piezoelectric element of the first piezoelectric pump 3. Therefore, the power efficiency of the piezoelectric pumps 3 and 5 connected in series can be improved.

Embodiment 3

Figures 12A, 12B, 12C:
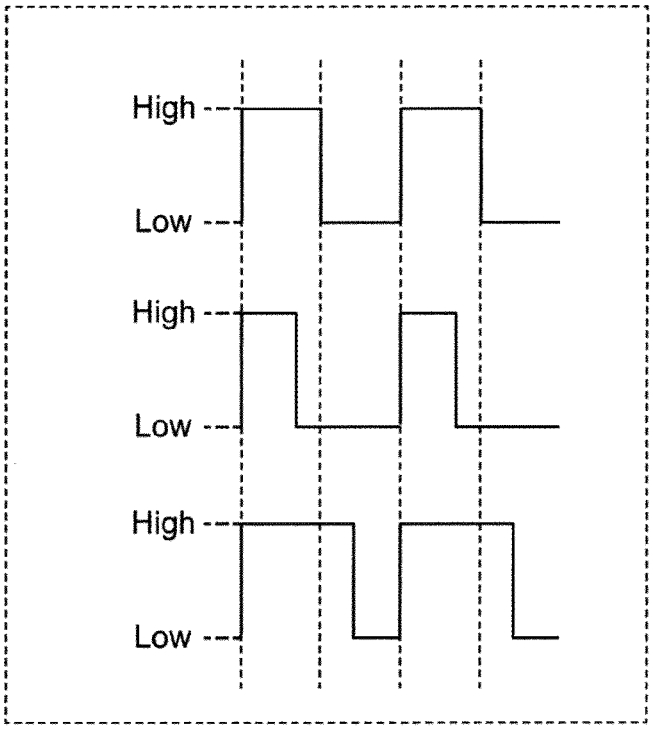
FIGS. 12A-12C are diagrams illustrating a change in a duty ratio of a drive voltage in Embodiment 3.

Next, a pump device according to Embodiment 3 of the present disclosure will be described with reference to FIGS. 12A-12C. FIGS. 12A-12C are diagrams illustrating control of the pump device according to Embodiment 3. FIG. 12A illustrates voltage control with a duty ratio of 1. FIG. 12B illustrates voltage control with a duty ratio <1. FIG. 12C illustrates voltage control with a duty ratio >1.

The pump device 1 according to Embodiment 1 controls the current flowing through the piezoelectric pump using the control unit 15. On the other hand, the control unit 15 of the pump device 1 according to Embodiment 3 controls the drive current flowing through the first piezoelectric pump 3 and the second piezoelectric pump 5 by controlling the duty ratio of the drive voltage of the piezoelectric pump.

The pump device 1 according to Embodiment 3 includes the same components as those of the pump device 1 according to Embodiment 1. Therefore, the configuration of the pump device 1 according to Embodiment 3 is the same as that of the pump device 1 according to Embodiment 1 except for the matters described below.

At the beginning of driving of the first piezoelectric pump 3 and the second piezoelectric pump 5, as illustrated in FIG. 12B or FIG. 12C, the control unit 15 controls the drive voltage in a state of duty ratio ≠1. As illustrated in FIG. 12A, as the back pressure becomes higher, the duty ratio of the drive voltage for driving the second piezoelectric pump 5 is brought to close to 1. Thus, the current flowing through the piezoelectric element of the second piezoelectric pump 5 can be increased, and the reduction in amplitude can be reduced. Note that, when the duty ratio is controlled to 1, the control unit 15 may raise the drive voltage of the second piezoelectric pump 5 by increasing the power supplied from the power supply unit 8 to the drive unit 7 as in Embodiment 1. In addition, instead of the duty control, frequency control of the drive voltage may be performed. In addition, a drive waveform may be a trapezoidal wave or a sine wave.

According to Embodiment 3, since the drive voltage of the second piezoelectric pump 5 can be controlled more precisely, the power efficiency of the piezoelectric pumps 3 and 5 connected in series can be further improved.

Embodiment 4

Figure 13:
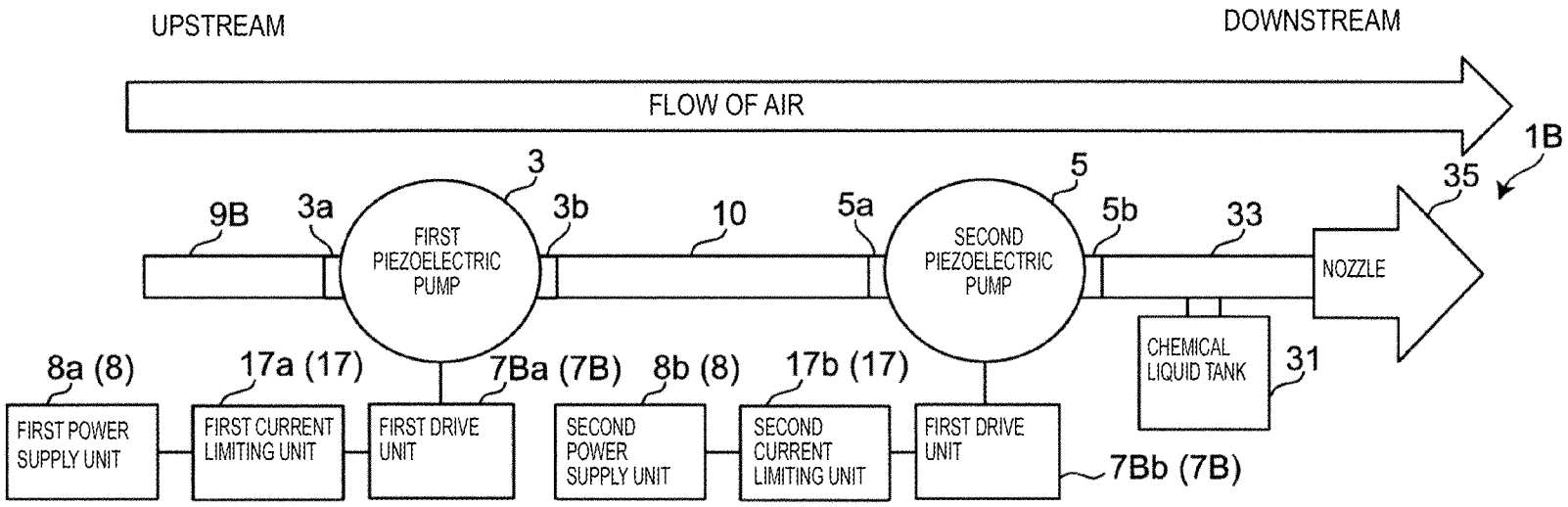
FIG. 13 is a diagram illustrating a schematic configuration of a pump device according to Embodiment 4.
Figure 14:
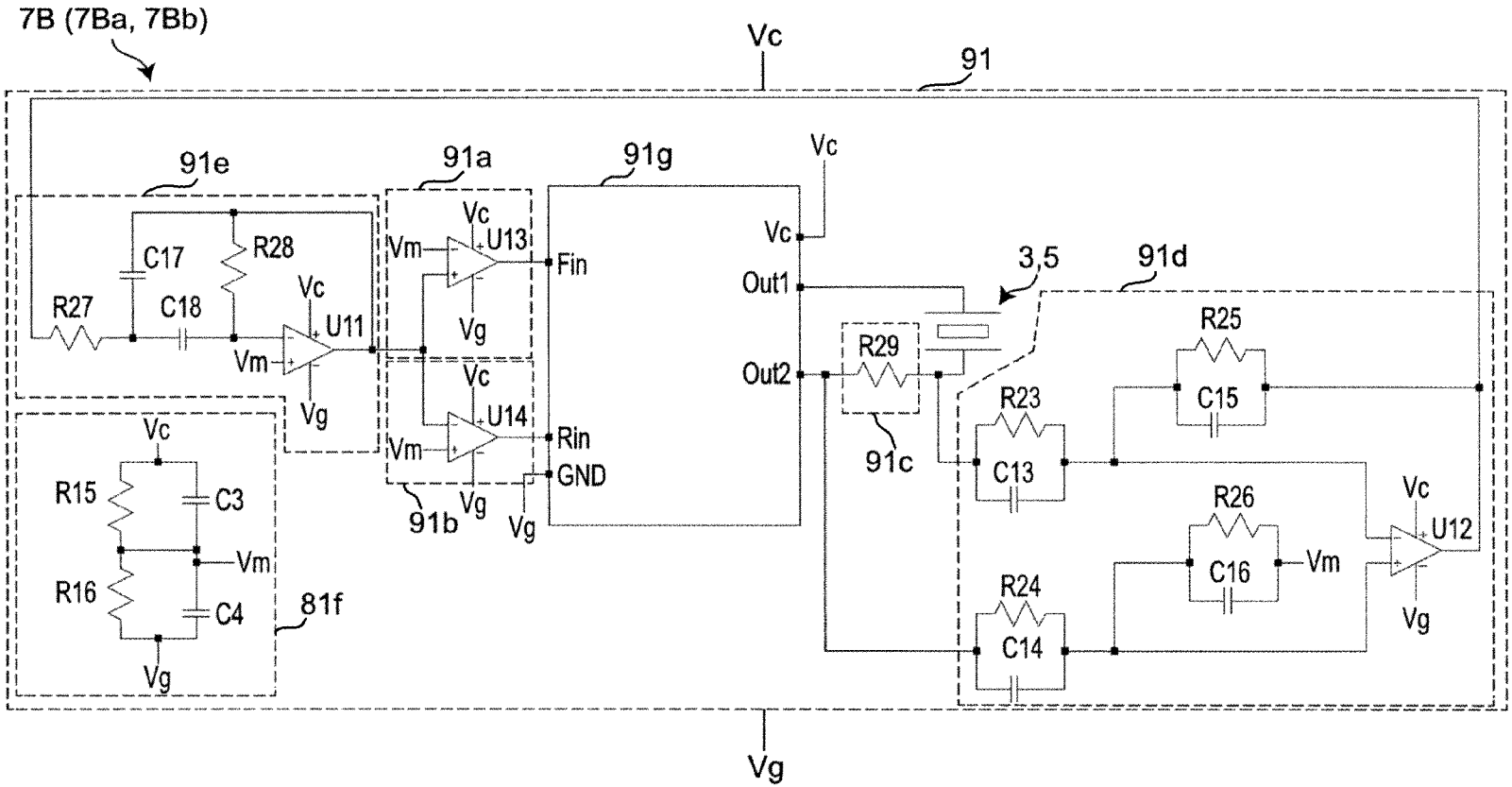
FIG. 14 is a circuit diagram illustrating a self-excitation circuit of a drive unit according to Embodiment 4.

Next, a pump device according to Embodiment 4 of the present disclosure will be described with reference to FIG. 13 and FIG. 14. FIG. 13 is a diagram illustrating a schematic configuration of a pump device 1B according to Embodiment 4. FIG. 14 is a diagram illustrating a self-excitation circuit 91 of a drive unit 7B of the pump device 1B according to Embodiment 4.

In Embodiment 1, the pump device 1 is used as a negative pressure pump while the container 11 is connected to the second piezoelectric pump 5, but the pump device is not limited to such a case. For example, instead of the container 11, a pressurizing target object such as a cuff may be connected to the discharge port 3*b* of the first piezoelectric pump 3, and the pump device may be used as a pressurizing pump. Examples of a pressurizer used as the pressurizing pump include a pMDI, a sphygmomanometer, a nebulizer, and the like. Note that, the pump device 1B according to Embodiment 4 will be described as a nebulizer which is an intake pump device.

The pump device 1 according to Embodiment 1 controls the current flowing through the first piezoelectric pump 3 and the second piezoelectric pump 5 by using the control unit 15. In a case where the pump device 1 is a pressurizing device, in Embodiment 1, the control unit 15 may raise the voltage Vc supplied to the first drive unit 7*a* that drives the first piezoelectric pump 3 on the upstream side to be relatively higher than the voltage Vc supplied to the second drive unit 7*b* that drives the second piezoelectric pump 5 on the downstream side. On the other hand, since the pump device 1B according to Embodiment 4 is provided with the self-excitation circuit 91 in the drive unit 7B, the drive unit 7B determines drive frequencies suitable for each of the piezoelectric pumps 3 and 5.

The pump device 1B according to Embodiment 4 includes the same components as those of the pump device 1 according to Embodiment 1. Therefore, the configuration of the pump device 1B according to Embodiment 4 is the same as that of the pump device 1 according to Embodiment 1 except for the matters described below.

The pump device 1B includes the first piezoelectric pump 3, the second piezoelectric pump 5, the drive unit 7B, the power supply unit 8, and a current limiting unit 17.

The power supply unit 8 of Embodiment 4 is a power supply circuit that supplies power to the current limiting unit 17. The current limiting unit 17 is supplied with power from the power supply unit 8 and limits the current supplied to the drive unit 7B. The current limiting unit 17 includes a first current limiting unit 17*a* that limits the current supplied to a first drive unit 7Ba and a second current limiting unit 17*b* that limits the current supplied to a second drive unit 7Bb. The first power supply unit 8*a* supplies power to the first current limiting unit 17*a*, and the second power supply unit 8*b* supplies power to the second current limiting unit 17*b*.

The discharge port 5*b* of the second piezoelectric pump 5 communicates with a chemical liquid tank 31 via a pipe 33. An end portion on the upstream side of a pipe 9B connected to the suction port 3*a* of the first piezoelectric pump 3 is open to the atmosphere. Air is sucked from an open end of the pipe 9B to the first piezoelectric pump 3 and further sucked into the second piezoelectric pump 5 via the pipe 10. The discharge port 5*b* of the second piezoelectric pump 5 and a nozzle 35 are connected with the pipe 33 interposed therebetween. The air discharged from the discharge port 5*b* of the second piezoelectric pump 5 is mixed with a chemical liquid in the chemical liquid tank 31, and the pressurized air containing the chemical liquid is discharged from the nozzle 35 into the atmosphere.

The drive unit 7B includes the self-excitation circuit 91. The self-excitation circuit 91 includes a first differential amplifier circuit 91*a*, a second differential amplifier circuit 91*b*, a current sensing portion 91*c*, a third differential amplifier circuit 91*d*, an active band filter 91*e*, the intermediate potential generation circuit 81*f*, and an H-bridge circuit 91*g*.

A resistance R29 of the current sensing portion 91*c* is connected in series to the piezoelectric elements of the first piezoelectric pump 3 and the second piezoelectric pump 5. Both ends of the resistance R29 are connected to input terminals of the third differential amplifier circuit 91*d*. The third differential amplifier circuit 91*d* differentially amplifies the voltage across the resistance R29 generated by the drive current flowing through the piezoelectric element, and outputs a voltage signal.

An output terminal of the third differential amplifier circuit 91*d* is connected to an input terminal of the active band filter 91*e*. The active band filter 91*e* amplifies the input voltage signal with a predetermined gain and outputs the amplified signal. A pass band of a band pass filter in the active band filter 91*e* is set so that a resonant frequency of a predetermined vibration modes of the piezoelectric element is within the pass band in order to further stabilize the frequency of the piezoelectric pump.

An output terminal of the active band filter 91*e* is connected to an input terminal of the first differential amplifier circuit 91*a* and to an input terminal of the second differential amplifier circuit 91*b*. The second differential amplifier circuit 91*b* is an inverting amplifier circuit. An output terminal of the first differential amplifier circuit 91*a* is connected to an input port Fin of the H-bridge circuit 91*g*. An output terminal of the second differential amplifier circuit 91*b* is connected to an input port Rin of the H-bridge circuit 91*g*.

The first differential amplifier circuit 91*a* generates a first drive signal based on the DC power supply voltage Vc output from the power supply unit 8 via the current limiting unit 17. An output signal of the first differential amplifier circuit 91*a* is a rectangular wave having a duty ratio of 50%.

The second differential amplifier circuit 91*b* generates a second drive signal based on the DC power supply voltage Vc output from the power supply unit 8 via the current limiting unit 17. An output signal of the second differential amplifier circuit 91*b* is a rectangular wave having a duty ratio of 50% whose phase is inverted with respect to the output signal of the first differential amplifier circuit 91*a*.

The H-bridge circuit 91*g* is an IC chip that has the same function as the H-bridge circuit of the drive unit 7 of Embodiment 1. Although not illustrated, the H-bridge circuit 91*g* includes the first FET 61 to the fourth FET 64 inside thereof. The output of the first differential amplifier circuit 91*a* and the output of the second differential amplifier circuit 91*b* serve as drive signals to the first FET 61 to the fourth FET 64 of the H-bridge circuit 91*g*. The first FET 61 to the fourth FET 64 each are switching-driven by these drive signals, and the output of the H-bridge circuit 91*g* is input to each of the upper side and the lower side of the piezoelectric pumps 3 and 5 in the same manner as in Embodiment 1, so that currents having opposite phases flow in the upper side and the lower side of the piezoelectric pumps 3 and 5.

Note that, the pass band of the band pass filter in the active band filter 91*e* may be such that the resonant frequency in the predetermined vibration mode of the piezoelectric element is outside the pass band. In addition, the output signals of the first differential amplifier circuit 91*a* and the second differential amplifier circuit 91*b* may be rectangular waves having a duty ratio of other than 50% in order to vary the duty ratio of the piezoelectric pump.

Figure 15:
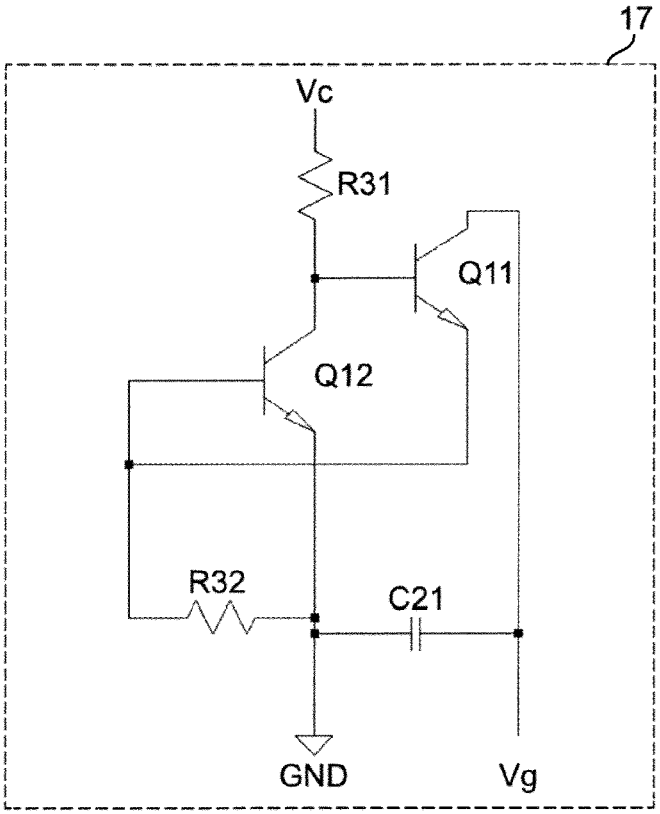
FIG. 15 is a circuit diagram of a current limiting unit according to Embodiment 4.

The configuration of the current limiting unit 17 will be described with reference to FIG. 15. FIG. 15 is a circuit diagram of a current limiting unit according to Embodiment 4. The current limiting unit 17 is set so as to operate at or below the upper limit drive current value I1 flowing through the piezoelectric pump. The output voltage of the power supply unit 8 is set to a voltage at which the piezoelectric pump sufficiently operates even when the external and internal environments such as the temperature of the piezoelectric pump and the pump pressure change. As a result, the piezoelectric pump is controlled to operate at a constant drive current value. Hereinafter a detailed description will be given.

A voltage Vg is determined by the self-excitation circuit 91 of the drive unit 7B and voltage dividing of the current limiting unit 17. The voltage Vg operates linearly with respect to the drive circuit voltage Vc and the drive current Ic when the voltage Vg is equal to or lower than a voltage determined by a resistance R32 and a transistor Q12. When the drive current Ic increases and the current flowing through the resistance R32 increases, the voltage across the resistance R32 is inverted to ON between a base and an emitter of the transistor Q12. For example, when the voltage becomes equal to or more than 0.6 V, a base voltage of a transistor Q11 decreases, and the transistor Q11 is temporarily turned off. As a result, the drive current Ic becomes zero, but at this time, the base voltage of the transistor Q11 becomes close to the drive circuit voltage Vc, so that the transistor Q11 is turned on and the drive current Ic flows again. By repeating these operations, the drive current Ic linearly operates up to the vicinity of the current Io determined by the transistor Q12 and the resistance R32, but operates as a current limiting circuit in which a current equal to or larger than Io does not flow. Note that, the transistors Q11 and Q12 of the current limiting unit 17 may be bipolar transistors or FETs.

At the start of driving of the piezoelectric pumps 3 and 5, the drive circuit voltage Vc is common between the first drive unit 7Ba on the upstream side and the second drive unit 7Bb on the downstream side. After driving, the drive circuit voltage Vc of the piezoelectric pump 5 on the downstream side is raised until the drive current Ic flowing through the piezoelectric pump 3 on the upstream side is reached. The ratio between the power supply unit 8 and the drive unit 7B does not have to be 1:1. For example, an attenuator may be used.

With also the configuration of the pump device 1B according to Embodiment 4, similarly to the pump device 1 according to Embodiment 1, even when the first piezoelectric pump 3 and the second piezoelectric pump 5 are driven and the pump pressure of the second piezoelectric pump 5 on the downstream side becomes higher than the pump pressure of the first piezoelectric pump 3, since the input power of the second piezoelectric pump 5 is larger than the input power of the first piezoelectric pump 3, the amplitude of the piezoelectric element of the second piezoelectric pump 5 can be brought close to the amplitude of the piezoelectric element of the first piezoelectric pump 3. Therefore, the power efficiency of the piezoelectric pumps 3 and 5 connected in series can be improved.

Although the present disclosure has been described with reference to the above-described embodiments, the present disclosure is not limited to the above-described embodiments.

In addition, in the above-described embodiment, the case where two piezoelectric pumps of the first piezoelectric pump 3 and the second piezoelectric pump 5 are provided has been described, however, the disclosure is not limited to such a case, and three or more piezoelectric pumps may be provided. In this case, when the input power of any adjacent piezoelectric pumps among the plurality of piezoelectric pumps is set to be larger on the downstream side than on the upstream side, the same effect can be achieved. In this case, it is optional to set the input power of all the adjacent piezoelectric pumps in this manner, and when the input power of at least two adjacent piezoelectric pumps is set as described above, the same effect can be achieved.

In addition, in the above-described embodiment, the case where the common control unit 15 is assigned to the first drive unit 7*a* and the second drive unit 7*b* has been described, but the present disclosure is not limited thereto. The control unit 15 may be separately provided for each of the first drive unit 7*a* and the second drive unit 7*b*.

In addition, in each of the embodiments described above, the drive voltage may have an appropriate voltage difference even at the start of driving according to the variation or the state of the piezoelectric pump.

While the present disclosure has been fully described in connection with the embodiments thereof with reference to the accompanying drawings, various changes and modifications will become apparent to those skilled in the art. Such variations and modifications are to be understood as included within the scope of the present disclosure as defined by the appended claims unless they depart therefrom. Also, changes in the combination or order of elements in each embodiment may be realized without necessarily departing from the scope and spirit of the present disclosure.

INDUSTRIAL APPLICABILITY

The present disclosure is useful for a pump device using a piezoelectric element.

REFERENCE SIGNS LIST

1 PUMP DEVICE
3 FIRST PIEZOELECTRIC PUMP
3*a* SUCTION PORT
3*b* DISCHARGE PORT
5 SECOND PIEZOELECTRIC PUMP
5*a* SUCTION PORT
5*b* DISCHARGE PORT
7, 7A DRIVE UNIT
7*a* FIRST DRIVE UNIT
7*b* SECOND DRIVE UNIT
8 POWER SUPPLY UNIT
8*a* FIRST POWER SUPPLY UNIT
8*b* SECOND POWER SUPPLY UNIT
9 PIPE
10 PIPE
11 CONTAINER
13 VOLTAGE DETECTION CIRCUIT
15 CONTROL UNIT
17 CURRENT LIMITING UNIT
17*a* FIRST CURRENT LIMITING UNIT
17*b* SECOND CURRENT LIMITING UNIT
31 CHEMICAL LIQUID TANK
33 PIPE
35 NOZZLE
81 SELF-EXCITATION CIRCUIT
91 SELF-EXCITATION CIRCUIT

The invention claimed is:

1. A pump device comprising:

a first piezoelectric pump;

a second piezoelectric pump connected in series with the first piezoelectric pump on a downstream side of the first piezoelectric pump;

a driver configured to supply AC input power to each of the first piezoelectric pump and the second piezoelectric pump;

a controller configured to control an input power of each of the first piezoelectric pump and the second piezoelectric pump; and a power supply configured to supply power to the driver, wherein the controller is configured to control the input power of the second piezoelectric pump to be larger than the input power of the first piezoelectric pump based on a negative pressure in a container that is connected to an upstream side of the first piezoelectric pump.

2. The pump device according to claim 1, wherein the driver comprises a first driver configured to supply AC input power to the first piezoelectric pump, and a second driver configured to supply AC input power to the second piezoelectric pump, and wherein the controller is configured to control power supplied from the power supply to the second driver to be larger than power supplied from the power supply to the first driver.

3. The pump device according to claim 2, further comprising:

a first current detection circuit configured to detect a current flowing through the first driver; and a second current detection circuit configured to detect a current flowing through the second driver, wherein the controller is configured to control the input power supplied to the second piezoelectric pump so that a current value detected by the second current detection circuit approaches a current value detected by the first current detection circuit.

4. The pump device according to claim 1, wherein the controller is configured to control a duty ratio of a drive voltage of the second piezoelectric pump.

5. The pump device according to claim 3, wherein the controller is configured to control a duty ratio of a drive voltage of the second piezoelectric pump.

6. The pump device according to claim 1, wherein the controller is configured to control drive frequencies of the first piezoelectric pump and the second piezoelectric pump.

7. The pump device according to claim 3, wherein the controller is configured to control drive frequencies of the first piezoelectric pump and the second piezoelectric pump.

8. The pump device according to claim 4, wherein the controller is configured to control drive frequencies of the first piezoelectric pump and the second piezoelectric pump.

9. The pump device according to claim 1, wherein a current ratio between a current flowing through the first piezoelectric pump and a current flowing through the second piezoelectric pump is equal to or greater than 0.8 and equal to or less than 1.2.

10. The pump device according to claim 2, wherein a current ratio between a current flowing through the first driver and a current flowing through the second driver is equal to or greater than 0.8 and equal to or less than 1.2.

11. The pump device according to claim 3, wherein a current ratio between a current flowing through the first piezoelectric pump and a current flowing through the second piezoelectric pump is equal to or greater than 0.8 and equal to or less than 1.2.

12. The pump device according to claim 4, wherein a current ratio between a current flowing through the first piezoelectric pump and a current flowing through the second piezoelectric pump is equal to or greater than 0.8 and equal to or less than 1.2.

13. The pump device according to claim 6, wherein a current ratio between a current flowing through the first piezoelectric pump and a current flowing through the second piezoelectric pump is equal to or greater than 0.8 and equal to or less than 1.2.

14. The pump device according to claim 1, further comprising:

a container connected to a suction port of the first piezoelectric pump or a discharge port of the second piezoelectric pump.

* * * * *